United States Patent [19]

Jacobson et al.

[11] Patent Number: 4,912,784

[45] Date of Patent: Apr. 3, 1990

[54] TOILET BOWL SPLASH GUARD

[76] Inventors: Earl B. Jacobson, 510 S. Shore Dr.; Keith R. Basler, 670 Coventry La., both of Crystal Lake, Ill. 60014

[21] Appl. No.: 221,506

[22] Filed: Jul. 19, 1988

[51] Int. Cl.[4] ..... E03D 9/02; A47K 13/04

[52] U.S. Cl. ..... 4/300.3; 4/222; 4/248; 222/192; 222/214; 239/274; 239/327

[58] Field of Search ..... 4/300.3, 222, 229, 230–233, 4/248, DIG. 5, 251; 16/86 A, 86 R, 250, 251; 222/192, 206, 214, 215; 239/289, 274, 327

[56] References Cited

U.S. PATENT DOCUMENTS

| | | | |
|---|---|---|---|
| 1,221,340 | 4/1917 | Lewers | 4/229 |
| 1,839,207 | 1/1932 | Dreisbach | 4/248 |
| 2,760,209 | 8/1956 | Ewing et al. | 239/274 |
| 3,193,845 | 7/1965 | Funk | 4/300.3 |
| 3,313,061 | 4/1967 | Dolac | 239/274 |
| 3,931,649 | 1/1976 | Jankowski | 4/DIG. 5 |
| 3,995,325 | 12/1976 | Baffico | 4/DIG. 5 |
| 4,040,142 | 8/1977 | Ippolito | 16/251 |
| 4,344,253 | 8/1982 | Stiles | 16/251 |
| 4,670,916 | 6/1987 | Bloom | 4/222 |
| 4,766,619 | 8/1988 | Takeda | 4/248 |

FOREIGN PATENT DOCUMENTS

| | | | |
|---|---|---|---|
| 0460041 | 1/1937 | United Kingdom | 4/231 |

*Primary Examiner*—Henry J. Recla
*Assistant Examiner*—Casey Jacyna
*Attorney, Agent, or Firm*—Leydig, Voit & Mayer

[57] ABSTRACT

A guard for a toilet hinge coupling a toilet seat to a toilet bowl. The guard includes an easily cleanable, impervious shield member that shields the toilet hinge and surrounding area from foreign matter, without interfering with the operation of the toilet hinge or movement of the toilet seat, and a member for releasably securing the shield member at least to the toilet bowl.

9 Claims, 2 Drawing Sheets

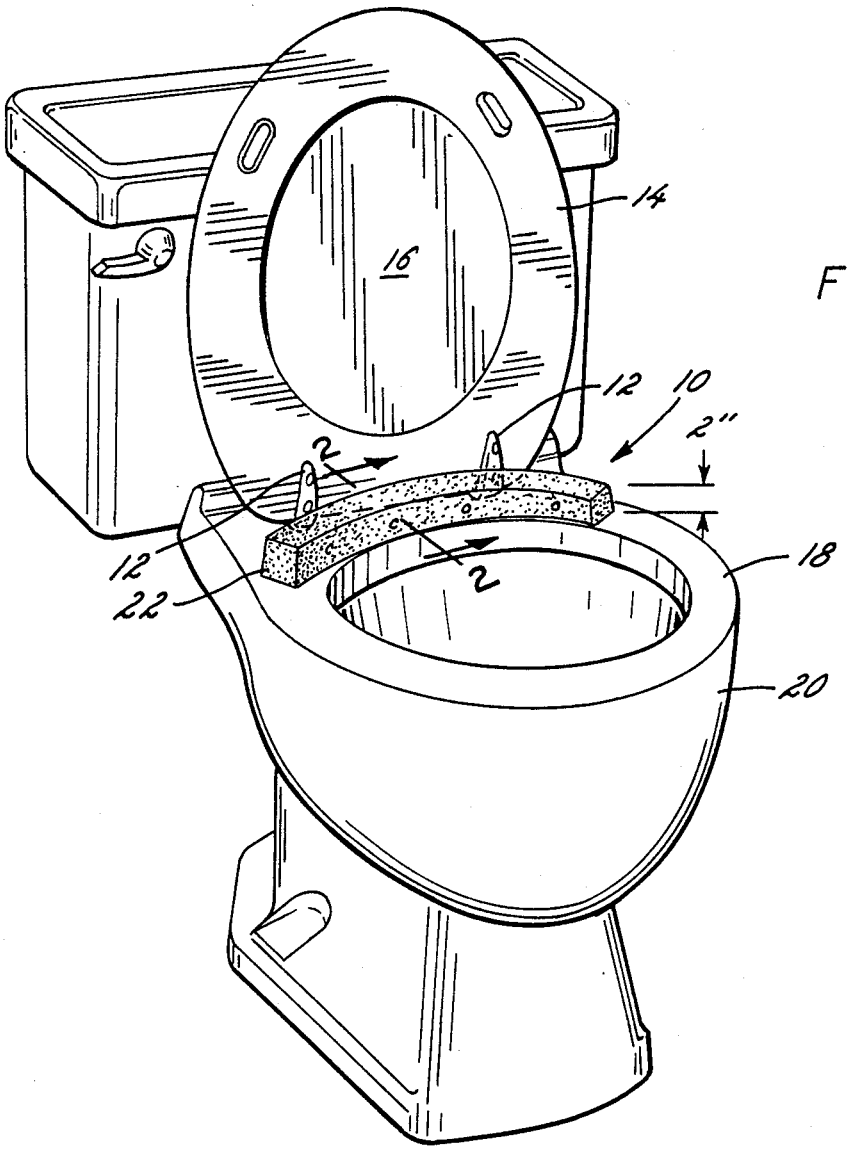
FIG. 1
FIG. 2
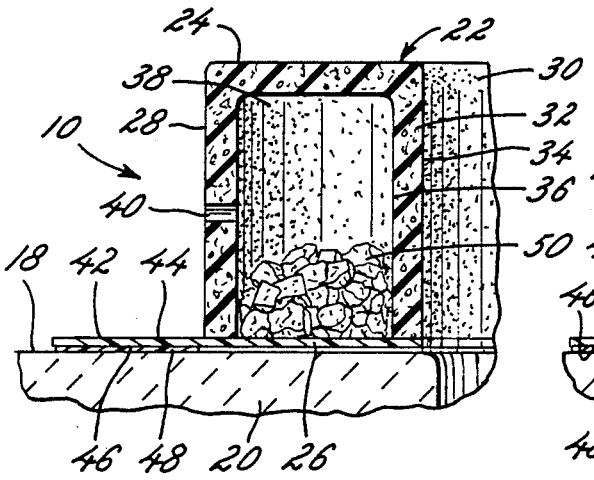
FIG. 3
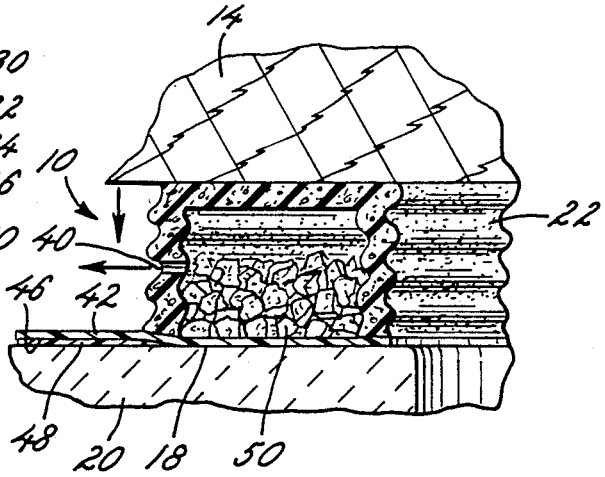

TOILET BOWL SPLASH GUARD

BACKGROUND OF THE INVENTION

This invention relates generally to a guard for a toilet bowl. More specifically, the invention relates to a splash guard for protecting a hinge of a toilet bowl and its associated components.

Toilet bowls having pivotably coupled seats or lid members or both are well known. These seat or lid members are normally coupled to a top, peripheral, engagement surface or rim on the toilet bowl by a hinge member. Such an arrangement enables a user to raise or lower the toilet seat or lid member as needed.

Toilet bowls and their associated components are typically used in harsh environments. These environments can include water, abrasive and toxic cleaners, as well as excremental matter. Accordingly, toilet bowls and their associated components preferably are made of impervious, noncorrosive materials and should be protected as much as possible, especially the working components.

It is also preferable that all undesirable matter from these environments be confined within the toilet bowl so that the surrounding floor, walls, woodwork, or carpeting is not damaged. This is especially important when harsh chemicals are used that are frequently sprayed from a container and can easily end up outside the toilet bowl. It is also important in households where children frequent the toilet since urine is inevitably sprayed around the hinge area, eventually landing on the floor, walls and other areas.

Additionally, although some areas of the toilet bowl are easily accessible for cleaning, the rear of the top rim of the toilet bowl, where the toilet seat and lid are hinged, is somewhat more difficult to clean. Cleaning of this area is inhibited, even with a specially designed sponge, brush, or similar article. Accordingly, dirt, urine, and other foreign matter more readily accumulates in this area.

Another problem with existing toilet bowls is that the toilet lid or toilet seat, or both, frequently fall down against the toilet bowl rim. This not only causes a loud, disruptive noise, but can also cause damage to the toilet bowl, toilet seat, or toilet lid.

It is also sometimes desirable to provide a scent to the toilet bowl and its immediate area after use. Such a scent not only masks any existing odors, but can also include a disinfectant to minimize bacteria.

It would therefore be advantageous to provide a guard for a toilet bowl, toilet seat and/or toilet lid that shields the hinge and surrounding area from foreign material and is made from easily cleanable material. It would also be advantageous to provide such a guard that can also dampen the rotation of the members joined by the hinge, can provide a fresh scent to the area around the hinge each time the members are rotated and can be readily removed to enable easy cleaning of the hinge area.

SUMMARY OF THE INVENTION

The above and other disadvantages of the prior art are overcome in accordance with the present invention by providing a guard for a toilet hinge coupling a toilet seat to a toilet bowl. The guard includes a member for shielding the toilet hinge and surrounding area from foreign matter, without interfering with the operation of the toilet hinge or movement of the toilet seat, and a member for releasably securing the shield member at least to the toilet bowl. The shield member is formed from easily cleanable, impervious material. The guard can dampen the rotation of the toilet seat and can provide a scent to the area surrounding the toilet hinge.

BRIEF DESCRIPTION OF THE DRAWINGS

FIG. 1 is a perspective view of an embodiment of the guard of the present invention illustrated in conjunction with a toilet bowl and its associated components;

FIG. 2 is a cross-sectional view of the guard illustrated in FIG. 1 taken along lines 2—2 of FIG. 1;

FIG. 3 is a cross-sectional view of the guard illustrated in FIG. 1, similar to FIG. 2, illustrating the guard in a compressed position;

DESCRIPTION OF THE PREFERRED EMBODIMENTS

Figure 5:
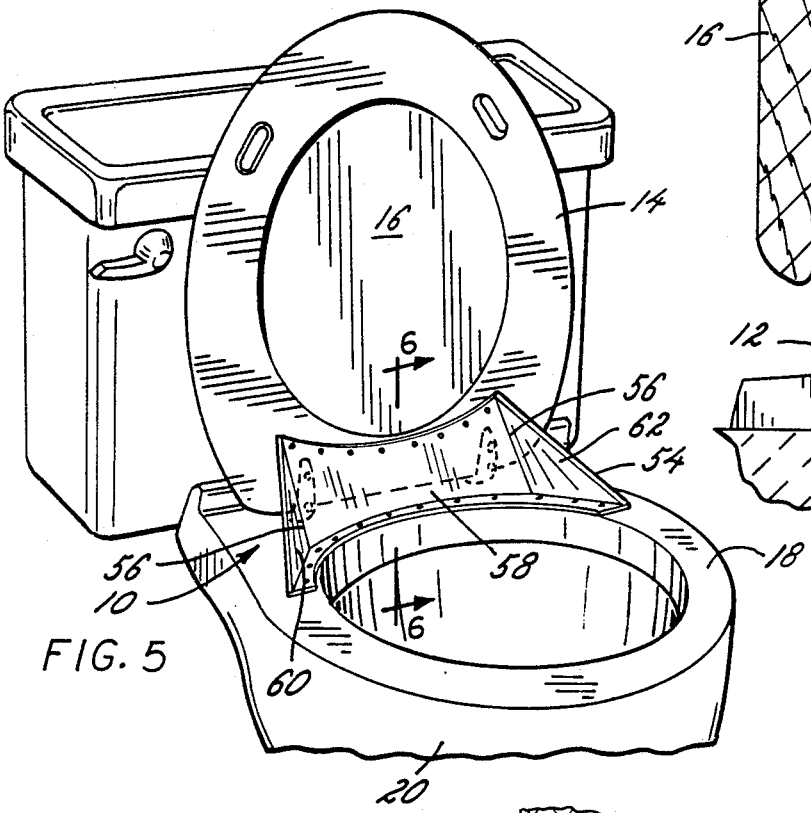
FIG. 5 is a perspective view of another embodiment of the guard of the present invention illustrated in conjunction with a toilet bowl and its associated components.

The present invention provides a guard for a hinge of a toilet bowl. As used herein, the term "guard" includes any device that can shield, cover or otherwise protect the hinge and surrounding area, especially from foreign material.

Referring now to FIG. 1, an embodiment of the guard of the present invention is generally indicated by reference numeral 10. The guard 10 is normally used to shield pivotable couples or hinges 12 and the area surrounding the hinges 12. The hinges 12 are used to couple a toilet seat 14 or a toilet lid 16, or both, to a top, peripheral, engagement surface or rim 18 of a toilet bowl 20. Additionally, the guard 10 can be used to dampen the rotation of the toilet seat 14, or the toilet lid 16, about the hinges 12 and can provide a scent to the area around the hinges 12. It is to be understood, however, that the guard 10 can be used to shield any type of pivotable couple or hinge 12, dampen the rotation of any member about the hinge 12 or provide a scent around the hinge 12 without departing from the spirit and scope of the present invention.

The guard 10, in the embodiment illustrated in FIGS. 13, includes a hollow, elongated, elastically deformable member 22. The member 22 can be shaped or bent to conform to the dimensions of the top, peripheral, engagement surface or rim 18 of the toilet bowl 20, and, in this embodiment, is crescent shaped having the general dimensions of 13″×1″×1 ¾″ (33.02cm×2.54cm×4.44cm). The member 22 has a top side 24, a bottom side 26, a rear side 28, and a front side 30. The member 22 can be made of any desired material that can be elastically deformed and, in this exemplary embodiment, is made of a highly elastically deformable and compressible closed cell foam material 32. The foam material 32 is encased in at least a smooth, impervious outer skin 34 which is easily cleanable and can also have a smooth, impervious inner skin 36.

The member 22 has a hollow interior 38 and a plurality of apertures 40 through its rear side 28 connecting the interior 88 with the exterior of the member 22. It is to be understood, however, that the number of apertures 40 as well as their positions in the member 22 can vary without departing from the teachings of the present invention.

A flange 42 preferably extends outwardly from the rear side 28 of the member 22 near its bottom side 26. The flange 42 can be integrally formed with the member 22 or can be secured to the member 22 in any desired way. The flange 42 has a top side 44 and a bottom side 46.

A fastening member 48 is used to secure the flange 42 and the member 22 to the top, peripheral, engagement surface 18 of the toilet bowl 20 proximate the hinges 12. Preferably, the fastening member 48 is composed of synthetic materials that adhere when pressed together, more commonly known as a VELCRO type fastener. Accordingly, a "hook" member is secured to the bottom side 46 of the flange 42, such as, for example, by an adhesive or adhesive strip. This "hook" member mates with a corresponding "loop" member that can be similarly secured to the top, peripheral, engagement surface 18 of the toilet bowl 20 to form the fastening member 48. Of course, the positions of the "hook" and "loop" members can be reversed. This type of VELCRO fastening member 48 can readily secure the guard 10 to the toilet bowl 20 and enables the guard 10 to be easily removed for cleaning or replacement. The type of fastening member 48 can vary and can include various types of adhesives or adhesive tape. Also, the fastening member 48 can extend under and be secured to the bottom side 26 of the member 22.

As FIG. 3 illustrates, to dampen the rotation of the toilet seat 14, the member 22 is compressed between the toilet seat 14 and the top, peripheral, engagement surface 18 of the toilet bowl 20 proximate the hinges 12. This not only restricts the rotation of the toilet seat 14, but prevents any loud noise from occurring from the toilet seat 14 falling down against the top, peripheral, engagement surface 18 of the toilet bowl 20.

In order to provide a scent to the area immediately surrounding the guard 10 and the hinges 12, the interior 38 of the hollow member 22 can include a desired quantity of scented granules 50. The scented granules 50 can be of any desired shape, size, material, and scent, so long as they are capable of emitting a scent. Additionally, to aid in reducing bacteria, the scent produced by the scented granules 50 may also provide a disinfectant to the area immediately surrounding the guard 10 and the hinges 12.

In operation, once the guard 10 is secured between the top, peripheral, engagement surface 18 of the toilet bowl 20 and the toilet seat 14 proximate the hinges 12 by the fastening member 48, the member 22 acts as a shield for the hinges 12 when the toilet seat 14 and toilet lid 16 are in their "up" positions. Any foreign matter is thereby impeded from reaching the hinges 12. Additionally, to provide the desired damping of the toilet seat 14 with respect to the toilet bowl 20, upon rotation of the toilet seat 14 to its "down" position, the member 22 is compressed between the toilet seat 14 and the top, peripheral, engagement surface 18 of the toilet bowl 20, as illustrated in FIG. 3. This damping is provided without interfering with the operation of the hinges 12 or the motion of the toilet seat 14. Moreover, to provide the desired scent, as the member 22 is deformed and compressed, air within the interior 38 of the member 22 that is scented by the granules 50 is forced out of the interior 38 of the member 22 through the apertures 40.

For cleaning of the guard 10, the member 22 is merely pulled away from the top, peripheral, engagement surface 18 of the toilet bowl 20, thereby releasing the fastening member 48. Thereafter, the guard 10 can be readily cleaned or replaced with a new guard 10. Also, when the guard 10 is removed, the area around the hinges 12 can be cleaned.

Figure 4:
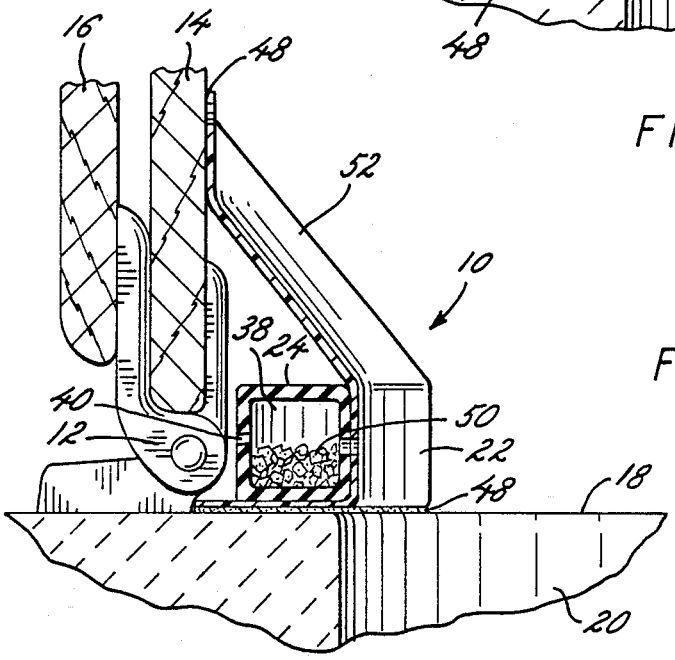
FIG. 4 is a cross-sectional view of another embodiment of the guard of the present invention illustrated in conjunction with a toilet bowl and its associated components.

Another embodiment of the guard 10 of the present invention is illustrated in FIG. 4 where common elements are referred to by the same numerals. In this embodiment, the member 22 includes a shield member 52. The shield member 52 is made from a thin, elongated sheet of pliable material, again the material is preferably impervious and easily cleanable. The member 52 is secured on one side to the toilet seat 14 by a fastening member 48 and, on its other side, is secured to or integrally formed with the top side 24 of the member 22. As in the previous embodiment, the fastener 48 can be a VELCRO type fastener or any other desired fastener, including an adhesive or adhesive tape. The shield member 52 spans the length of the member 22 and further aids in preventing any foreign matter from reaching the hinges 12.

In operation, when the toilet seat 14 is rotated to its "down" position, the shield member 52 neatly folds up between the top side 24 of the member 22 and the toilet seat 14. The guard 10 functions thereafter in the same way as the guard of the previous embodiment illustrated in FIGS. 1–3.

Figure 6:
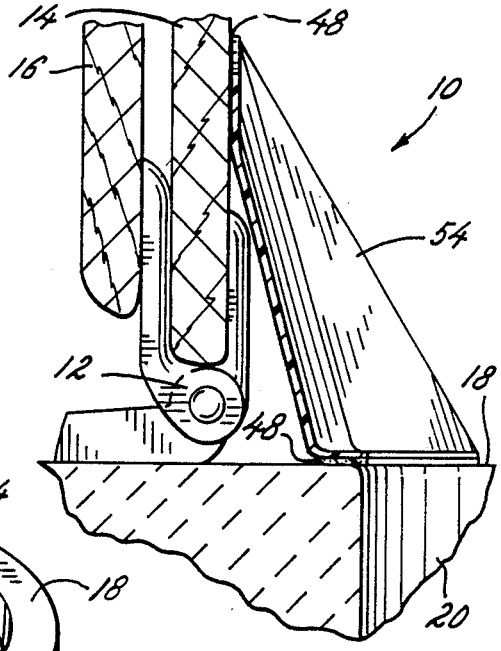
FIG. 6 is a cross-sectional view of the guard illustrated in FIG. 5 taken along lines 6-6 of FIG. 5.
Figure 7:
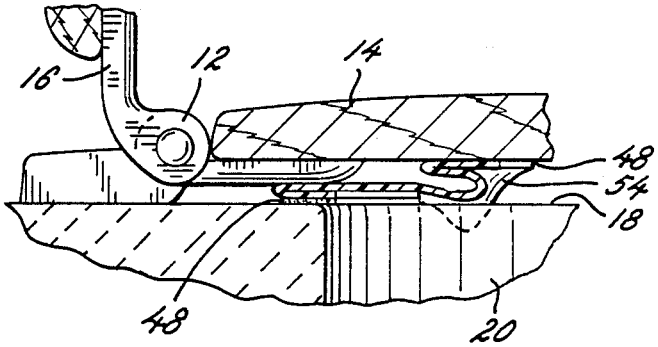
FIG. 7 is a cross-sectional view of the guard illustrated in FIG. 5, illustrating the guard in a deformed position.

Another embodiment of the guard 10 of the present invention is illustrated in FIGS. 5–7 where again, common elements are referred to by the same numerals. In this embodiment, the guard 10 includes a relatively thin, elongated, pliable, impervious and easily cleanable shield member 54. The shield member 54 is secured on one longitudinal side to the toilet seat 14 and on its other longitudinal side to the top, peripheral, engagement surface 18 of the toilet bowl 20. The shield member 54 can be secured on either side by fastening members 48 that can be VELCRO type fasteners, as described above, or any other desirable fasteners, including an adhesive or adhesive tape. The shield member 54 thereby guards the hinges 12 from any foreign matter.

Additionally, as FIG. 5 illustrates, the shield member 54 can include creases 56 positioned proximate its longitudinal ends. When the toilet seat 14 and the toilet lid 16 are in their "up" positions, the creases 56 form a recessed portion 58 in the shield member 54 that is bordered by wall portions 60 and 62. Accordingly, the shield member 54 is formed into a type of funnel member that directs any foreign matter back into the toilet bowl 20.

As FIG. 7 illustrates, when the toilet seat 14 is rotated to its "down" position, the shield member 54 is readily folded between the toilet seat 14 and the top, peripheral, engagement surface 18 of the toilet bowl 20. Additionally, the shield member 54 can dampen the movement of the toilet seat 14 when folded and can provide a cushion between the toilet seat 14 and the top, peripheral, engagement surface 18 when the toilet seat 14 is in its "down" position.

Alternatively, the shield member 54 of FIGS. 5–7 can be formed of a more rigid material and can be secured only on one longitudinal side to the top, peripheral, engagement surface 18 of the toilet bowl 20 with a fastening member 48. The other longitudinal side of the shield member 54 can extend upward to a position proximate the toilet seat 14 when the toilet seat 14 is in its "up" position. In operation, when the toilet seat 14 is rotated to its "down" position, the toilet seat 14 contacts the shield member 54 and bends or folds the shield member 54 between the toilet seat 14 and the top, peripheral, engagement surface 18 of the toilet bowl 20. The shield member 54 can provide a spring bias against the toilet seat 14 to restrict and dampen its movement toward the toilet bowl 20. Although the shield member 54 can apply the desired spring bias due to its shape and material alone, the shield member 54 can also be designed with a living hinge (not illustrated) or an additional spring member (not illustrated) to accomplish the desired damping of the toilet seat 14 without departing from the teachings of the present invention.

Modifications and variations of the present invention are possible in light of the above teachings. A specific dimension, material or construction is not required so long as the assembled device is able to function as herein described. It is therefore to be understood that within the scope of the appended claims, the invention may be practiced otherwise than as specifically described.

What is claimed and desired to be secured by letters patent of the United States is:

1. A device for shielding a toilet hinge between a toilet seat and a toilet bowl, damping the rotation of the toilet seat about the toilet hinge, and emitting a desired scent around the toilet hinge comprising:

a toilet bowl having a peripheral engagement surface around its top surface thereof;

a toilet seat;

a toilet lid;

a hinge for pivotably coupling said toilet lid and said toilet seat to said peripheral engagement surface of said toilet bowl at a desired location;

an elongated, hollow, elastically compressible member positioned between said toilet seat and said peripheral engagement surface of said toilet bowl proximate said hinge, said compressible member having an easily cleanable, impervious exterior surface and at least one aperture extending from its interior to its exterior surface and being capable of compressing between said toilet seat and said peripheral engagement surface of said toilet bowl to dampen the motion of said toilet seat and shield said hinge against foreign matter;

scented granules within the interior of said compressible member, said scented granules being capable of emitting a scent through said at least one aperture of said compressible member upon compression of said compressible member to scent the area around said hinge; and means for releasably securing said compressible member to said peripheral engagement surface of said toilet bowl.

2. The device as defined in claim 1, wherein said scented granules include a deodorizer that is emitted through said at least one aperture of said compressible member along with said scent.

3. The device as defined in claim 1, wherein said releasably securing means includes synthetic materials that adhere when pressed together.

4. A guard for a toilet hinge coupling a toilet seat to a toilet bowl comprising:

means for shielding the toilet hinge and surrounding area from foreign matter without interfering with the operation of said toilet hinge or movement of the toilet seat;

means for releasably securing said shielding means at least to the toilet bowl; and said shielding means including means for scenting the area surrounding said toilet hinge upon rotation of said toilet seat about said toilet hinge, means for damping the rotation of said toilet seat about said toilet hinge, and a hollow, elastically deformable member having a predetermined quantity of scented granules within its interior, and at least one aperture therethrough to provide said sealing, damping and scenting.

5. The guard as defined in claim 4, wherein said shielding means include means for directing said foreign matter to a desired position with respect to said toilet hinge.

6. The guard as defined in claim 4, wherein said shielding means are positioned between said toilet seat and said toilet bowl proximate said toilet hinge and are elastically deformable upon rotation of said toilet seat about said toilet hinge.

7. The guard as defined in claim 4, wherein said hollow, elastically deformable member is positioned between said toilet seat and said toilet bowl proximate said toilet hinge and shields said toilet hinge and surrounding area from foreign matter, compresses between said toilet seat and said toilet bowl to provide damping of the movement of said toilet seat about said toilet hinge, and scents the area around said toilet hinge with the scent generated by said scented granules upon compression of said hollow, elastically deformable member by forcing scented air from within said hollow, elastically deformable member through said at least one aperture to the exterior of said hollow, elastically deformable member.

8. A guard for a toilet hinge coupling a toilet seat and a toilet bowl comprising:

a toilet bowl member having a peripheral engagement surface around its top surface thereof;

a toilet seat member;

hinge means for pivotably coupling said toilet seat member to said peripheral engagement surface of said toilet bowl member at a desired location;

means for shielding said hinge means and surrounding area from foreign matter without interfering with the operation of said hinge means or the movement of said toilet seat member with respect to said peripheral engagement surface of said toilet bowl member, said shielding means being positioned between said toilet seat member and said peripheral engagement surface of said toilet bowl member;

means for releasably securing said shielding means to said peripheral engagement surface of said toilet bowl member; and said shielding means dampens the rotation of said toilet seat member about said hinge means, scents the area surrounding said hinge means, and including a hollow, elastically deformable member having an impervious outer shell, a predetermined quantity of scented granules within its interior and at least one aperture therethrough and shields said hinge means and surrounding area from foreign matter, elastically compresses between said toilet seat member and said peripheral engagement surface of said toilet bowl to provide damping of said toilet seat member, and scents the area proximate said hinge means by releasing air from within said hollow, elastically deformable member that is scented by said granules through said at least one aperture to the exterior of said hollow elastically deformable member upon rotation of said toilet seat about said hinge means.

9. The guard as defined in claim 8, wherein said shielding means directs said foreign matter into said toilet bowl member.

* * * * *